US006513263B2

(12) United States Patent
Turcotte

(10) Patent No.: US 6,513,263 B2
(45) Date of Patent: Feb. 4, 2003

(54) VENTILATOR FOR OFFSET POCKET AND METHOD OF VENTILATING THE SAME

(75) Inventor: Rémi Turcotte, Léry (CA)

(73) Assignee: Enerquin Air Inc., Quebec (CA)

( * ) Notice: Subject to any disclaimer, the term of this patent is extended or adjusted under 35 U.S.C. 154(b) by 74 days.

(21) Appl. No.: 09/853,944

(22) Filed: May 11, 2001

(65) Prior Publication Data

US 2002/0040535 A1 Apr. 11, 2002

Related U.S. Application Data

(60) Provisional application No. 60/238,022, filed on Oct. 6, 2000.

(51) Int. Cl.[7] ..... F26B 3/00; F26B 11/02

(52) U.S. Cl. ..... 34/456; 34/444; 34/455; 34/463; 34/117; 34/120

(58) Field of Search ..... 34/444, 455, 456, 34/457, 463, 611, 618, 240, 117, 120, 126

(56) References Cited

U.S. PATENT DOCUMENTS

| | | | |
|---|---|---|---|
| 3,110,575 | A | 11/1963 | Justus |
| 3,250,019 | A | 5/1966 | Beachler |
| 3,337,968 | A | 8/1967 | Krikorian et al. |
| 3,384,973 | A | 5/1968 | Johansson |
| 3,388,479 | A | 6/1968 | Gardner |
| 4,172,007 | A | 10/1979 | Kankaanpaa |
| 4,416,070 | A | 11/1983 | Vedenpa et al. |
| 4,481,723 | A | 11/1984 | Vedenpaa |
| 4,485,567 | A | 12/1984 | Ely |
| 4,505,052 | A | 3/1985 | Osswald et al. |
| 4,516,330 | A | 5/1985 | Eskelinen et al. |
| 4,539,762 | A | 9/1985 | Eskelinen et al. |
| 4,602,439 | A | 7/1986 | Eskelinen et al. |
| 4,625,434 | A | 12/1986 | Karlsson et al. |
| 4,669,198 | A | 6/1987 | Wedel |
| 4,694,587 | A | 9/1987 | Eskelinen |
| 4,881,327 | A | 11/1989 | Hauser et al. |
| 4,891,891 | A | 1/1990 | Wedel |
| 4,893,741 | A | 1/1990 | Heinzmann |
| 4,986,009 | A | 1/1991 | Haessner et al. |
| 5,019,213 | A | 5/1991 | Virta et al. |
| 5,044,094 | A | 9/1991 | Ilvespaa et al. |
| 5,044,095 | A | 9/1991 | Eivola |
| 5,074,278 | A | 12/1991 | Turcotte |
| 5,086,571 | A | 2/1992 | Hietanen |
| 5,331,749 | A | 7/1994 | Thiele |
| 5,337,490 | A | 8/1994 | Griffin et al. |

(List continued on next page.)

FOREIGN PATENT DOCUMENTS

| | | |
|---|---|---|
| CA | 2051528 | 3/1993 |
| CA | 1316668 | 4/1993 |

*Primary Examiner*—Pamela Wilson
(74) *Attorney, Agent, or Firm*—Timothy J. Keefer; Wildman, Harrold, Allen & Dixon

(57) ABSTRACT

The ventilator is used to ventilate an offset pocket in the drying section of a papermaking machine. The papermaking machine comprises a row of spaced-apart upper drying rolls and a row of spaced-apart lower drying rolls. It also comprises two rows of spaced-apart felt rolls disposed intermediate the upper drying rolls and the lower drying rolls, respectively, and a paper web intermittently carried by two felts entrained over the upper drying rolls and over the lower drying rolls, respectively. The ventilator comprises a ventral face and a dorsal face. The ventral face comprises at least one ventral orifice disposed adjacent to the felt and the dorsal face comprises at least one dorsal orifice disposed adjacent to a combined draw of felt and paper web. In use, the ventral orifice discharges air through the open felt draw such that the air traverses the felt to the other side thereof and into the offset pocket, and wherein the dorsal orifice discharges air in a direction opposite to the direction of travel of the combined draw to create a countercurrent air flow between the ventilator and the felt roll. A method for ventilating an offset pocket is also disclosed. The ventilator and the method for ventilating improve the ventilation of offset pockets.

23 Claims, 8 Drawing Sheets

U.S. PATENT DOCUMENTS 5,379,526 A 1/1995 Haverinen
5,475,934 A 12/1995 Eskelinen et al.
5,477,624 A 12/1995 Haessner et al.
5,509,215 A 4/1996 Koiranen et al.
5,524,360 A 6/1996 Virta et al.
5,535,527 A 7/1996 Virta et al.
5,555,638 A 9/1996 Lehosvuo et al.
5,557,863 A 9/1996 Kokkala
5,560,123 A 10/1996 Eskelinen
5,600,897 A 2/1997 Sollinger et al.
5,628,124 A 5/1997 Skaugen et al.
5,661,911 A 9/1997 Yli-Kauppila
5,711,088 A 1/1998 Lindqvist et al.
5,718,058 A 2/1998 Atzinger
5,720,109 A 2/1998 Yli-Kauppila
5,728,930 A 3/1998 Virta
5,735,060 A 4/1998 Atzinger et al.
5,775,001 A 7/1998 Kerttula et al.
5,792,318 A 8/1998 Mancini
5,860,223 A 1/1999 Kahl
5,881,472 A 3/1999 Grunder et al.
5,887,358 A 3/1999 Bischel et al.
5,893,505 A * 4/1999 Mueller ..... 226/97.3
5,987,777 A 11/1999 Goebel et al.
5,996,244 A 12/1999 Saarikivi et al.
6,032,385 A * 3/2000 Bischel et al. ..... 34/456
6,076,280 A * 6/2000 Oechsle et al. ..... 34/456
6,119,362 A 9/2000 Sundqvist
6,260,287 B1 * 7/2001 Walker et al. ..... 34/455
6,412,192 B1 * 7/2002 Boucher et al. ..... 34/444

* cited by examiner

VENTILATOR FOR OFFSET POCKET AND METHOD OF VENTILATING THE SAME

The present application claims the benefits of U.S. provisional patent application No. 60/238,022 filed Oct. 6, 2000, which is hereby incorporated by reference.

Papermaking is a sophisticated operation involving massive and very expensive machines. Papermaking machines are increasingly running at higher speeds, meaning that their overall efficiency must be very high, and in particular, the efficiency of their sub-components must also be very high. Papermaking requires, inter alia, the drying of a pulp fiber solution by passing the pulp over a large number of drying rolls. The operation requires that the paper web be supported on a sheet, felt, wire, fabric or other support means as the web is advanced through the papermaking machine, and water is removed therefrom. The paper web moves from the wet end, at the beginning of the machine, to the dry end, located at the end thereof, where at the finished product (i.e. the paper) is reeled.

Papermaking machines may have a number of configurations. One configuration in particular is the one where the papermaking machine comprises two rows of heated drying cylinders or rolls over which the web (i.e. the wet paper being dried) is supported and is made to be in contact with. This contact of the paper web and the heated drying rolls is primarily responsible for the drying of the web. Felt rolls are provided intermediate the two rows of drying rolls. The felt rolls support felts that are also carried through the machine. In order to dry the paper web, it is desirable that the web be in direct contact with the drying rolls for as long as possible. However, at given intervals, the paper web is unsupported as the paper web passes from one drying roll to the other. Traditional drying roll and felt roll arrangements comprise placing of the felt roll intermediate the axis of rotation of the drying rolls, thus substantially halfway between two adjacent drying rolls. Inherent in the configuration and disposition is the fact that the paper web is unsupported at given intervals such as when one of the felts separates from the paper web to pass over a felt roll.

In order to increase the speed of papermaking machines and, at the same time, reduce the length of unsupported paper web, the disposition and configuration of the felt rolls where improved by moving the axis of rotation of the felt rolls backwards, i.e. towards the wet end of the machine. The resulting effect of moving the felt rolls backwards has been the creation of what is known as offset pockets. An offset pocket may be roughly described as the enclosed space limited by the felt roll, a drying roll either above or below it, and the paper web on both sides of the felt roll. The creation of offset pockets has resulted in the felt and the paper web being in contact longer, thus minimizing the length of unsupported paper web as it passes between adjacent drying rolls.

The ventilation of offset pockets is more difficult than with traditional configurations. Since one of the fundamental aspects of papermaking is the drying of the paper web, increased difficulty in ventilating the offset pockets may therefore be counter productive and limit the speed increases of papermaking machines. The difficulty created with the presence of the offset pockets is due in part to the elimination or reduction of the draw of felt without the paper web joined thereto, upstream of the felt roll and through which heated dry air was generally introduced there through. In an offset pocket, the felt at the upstream part of the pocket from a felt roll supports the paper web. Since the paper web is substantially impermeable to air, air cannot be blown through the felt and then into the pocket as it used to be. As a result, this decreases the air flow into the pocket, with a resultant decrease in the efficiency of the ventilation and drying of the paper web.

Now, in accordance with the present invention, it has been found that there is one area through which air may be introduced is on the dry end side of the pocket, between the point where the felt leaves the felt roll and the point where the felt comes into contact with the next drying roll. This allows to provide a ventilator and corresponding method which, with properly disposed orifices, can very suitably ventilate offset pockets.

The present invention is described in the following detailed description made in conjunction with the accompanying figures, in which.

Figure 1:
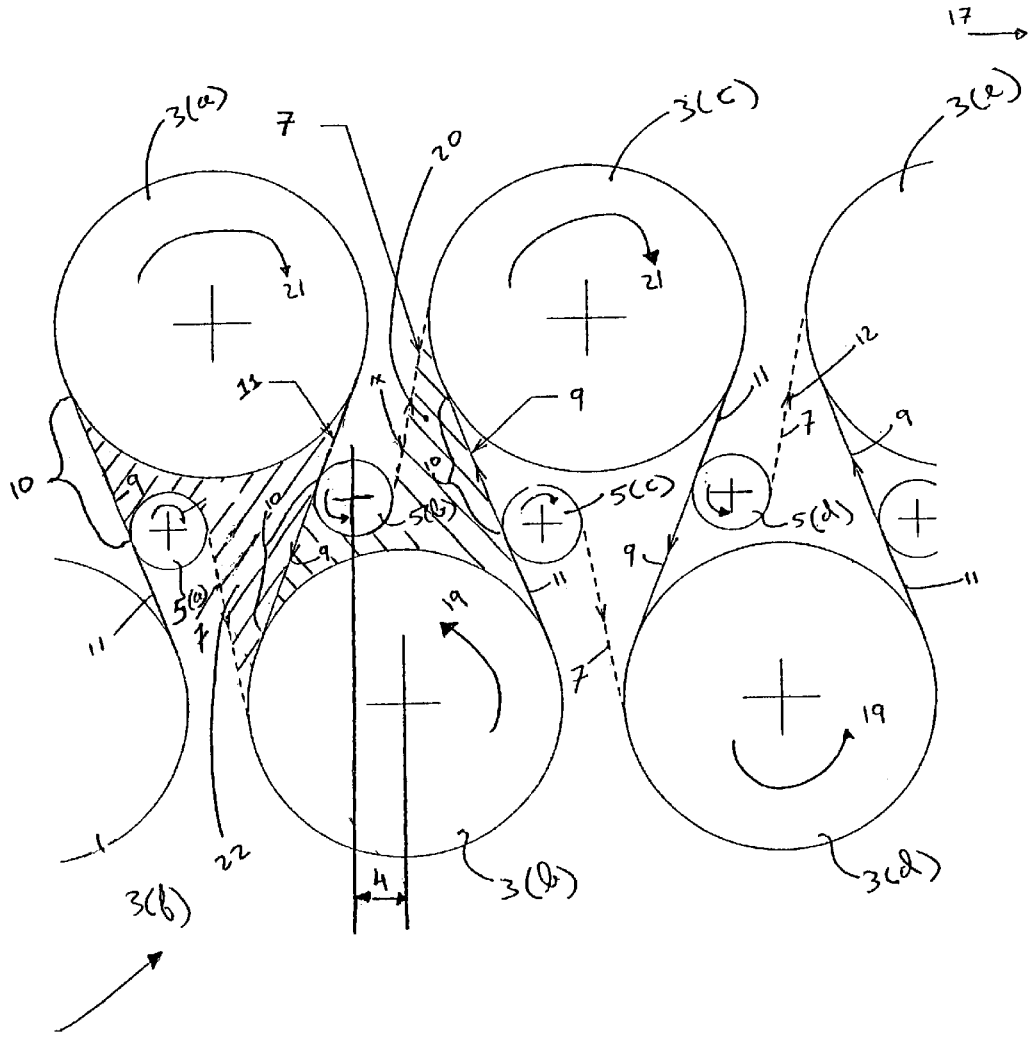
FIG. 1 is a schematic side elevation view of a typical drying section of a papermaking machine provided with offset pockets.

FIG. 1 is a schematic side elevation view of a portion of a typical drying section of a papermaking machine 1 and shows one possible configuration thereof. As illustrated, a papermaking machine 1 comprises a double row of spaced-apart drying rolls 3 which are disposed at substantially equal spacing one from another, namely upper rolls 3(*a*),3(*c*),3(*e*), and lower rolls 3(*b*),3(*d*). Intermediate each row of spaced-apart drying rolls 3, there is illustrated a row of felt rolls 5 disposed within a triangle formed by each set of three adjacent drying rolls 3. In FIG. 1, the direction of movement of the paper web 9 and the felts 7 is illustrated by various motion arrows.

The main purpose of the arrangement illustrated in FIG. 1 is to dry the paper web 9, which process involves, inter alia, the drying of the wet paper web 9 which is introduced at the wet end 15 of the drying section. The unfinished paper advances in a zig-zag path through the machine until eventually dry paper comes out at the dry end 17 thereof. Thus, as may be understood, a tremendous amount of moisture needs to be removed from the original pulp fiber solution forming the paper web 9 in order to leave behind the finished paper product. The wet paper web 9, which is unstable particularly at the wet end of the papermaking machine 1, needs to be supported by the felts 7 as it advances towards the dry end 17.

As illustrated, the paper web 9 is supported in alternance by one of the two felts 7. When the paper web 9 is supported by one of the felts 7, it is designated as the combined draw 11. The paper web 9 is at times unsupported, for example between felt roll 5(*a*) and drying roll 3(*a*). When unsupported, the paper web is hereby designated as unsupported draw 10.

The configuration and disposition of the drying rolls 3 and felt rolls 5 illustrated in FIG. 1 creates what is known as offset pockets 20,22, some of which are identified with the cross-hatching in FIG. 1. The offset pockets 20,22 may be characterized by the axis of rotation of the felt rolls 5 having been displaced backwards towards the wet end 15 of the papermaking machine 1. This offset arrangement is illustrated by distance 4 from the axis of rotation between one of the drying roll 3 and a corresponding upstream felt roll 5. Traditional felt roll and drying roll arrangements had the axis of rotation of a felt roll in substantially vertical alignment with the axis of rotation of a corresponding drying roll.

It should be noted that the term <<felt>> generically refers to a fabric, synthetic or otherwise, wire, screen or any other suitable carrier which may be configured or designed to carry the paper web 9, and which is permeable to air.

As also illustrated in FIG. 1, the configuration and disposition of the drying rolls 3 and of the felt rolls 5 define offset pockets which are either top pockets 20 or bottom pockets 22. Each of these pockets may be described as an enclosed space, open at both lateral sides, bounded by a felt roll 5, the paper web 9, a free surface of a drying roll 3 and the felt 7. As may be understood, each set of three drying rolls 3 have either a top pocket 20 or a bottom pocket 22 between them.

As illustrated, the felt rolls 5 are not disposed in a horizontal line, but rather vertically staggered. It is understood that the configuration and disposition of both the drying rolls 3 and felt rolls 5 may differ from that illustrated in FIG. 1 to meet the specific configuration of a particular papermaking machine.

The displacement of the felt rolls 5 towards the wet end 15 of the paper machine 1 has resulted in reducing the length of the unsupported draw 10 of the paper web 9. For example, the distance between a felt roll 5(*d*) and a preceding drying roll 3(*c*), comprises the paper web 9 being supported by one of the felts 7, referred to as the combined draw 11, for at least part of the distance between the drying roll 3(*c*) and the next drying roll 3(*d*).

Figure 2:
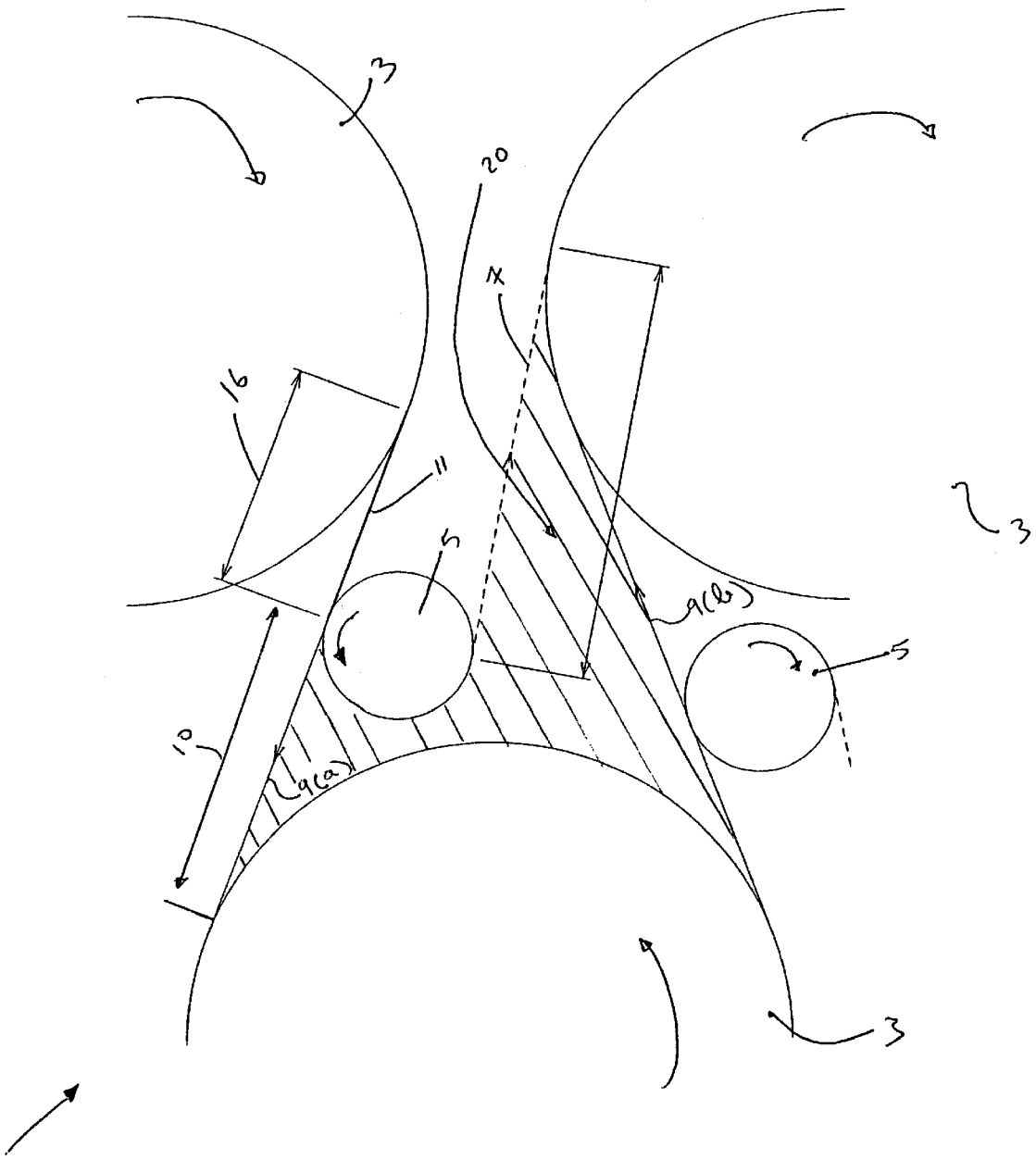
FIG. 2 is an enlarged schematic side elevation view of a drying section of a papermaking machine as shown in FIG. 1.

In FIG. 2, the offset pocket is identified by a cross hatched area bearing reference number 20, and is bounded at the top by a first section of the paper web 9(*a*), the corresponding felt 7 and second section of the paper web 9(*b*) and, at the bottom, by a free surface of the drying roll 3. As aforesaid, offset pockets 20 are usually open at lateral ends of the papermaking machine but could also be sealed at both lateral ends. As may be understood, ventilating an offset pocket 20 as illustrated was problematic because of the presence of the paper web 9(*a*) that is impermeable to air, especially at the combined draw 11. This part of the pocket is indicated by reference number 16. Further, unsupported paper web 9(*a*) is also impermeable to air, which distance is indicated by reference number 10. The felt roll 5 and the drying roll 3 are non porous so that evacuating air there through is not possible.

Figure 3:
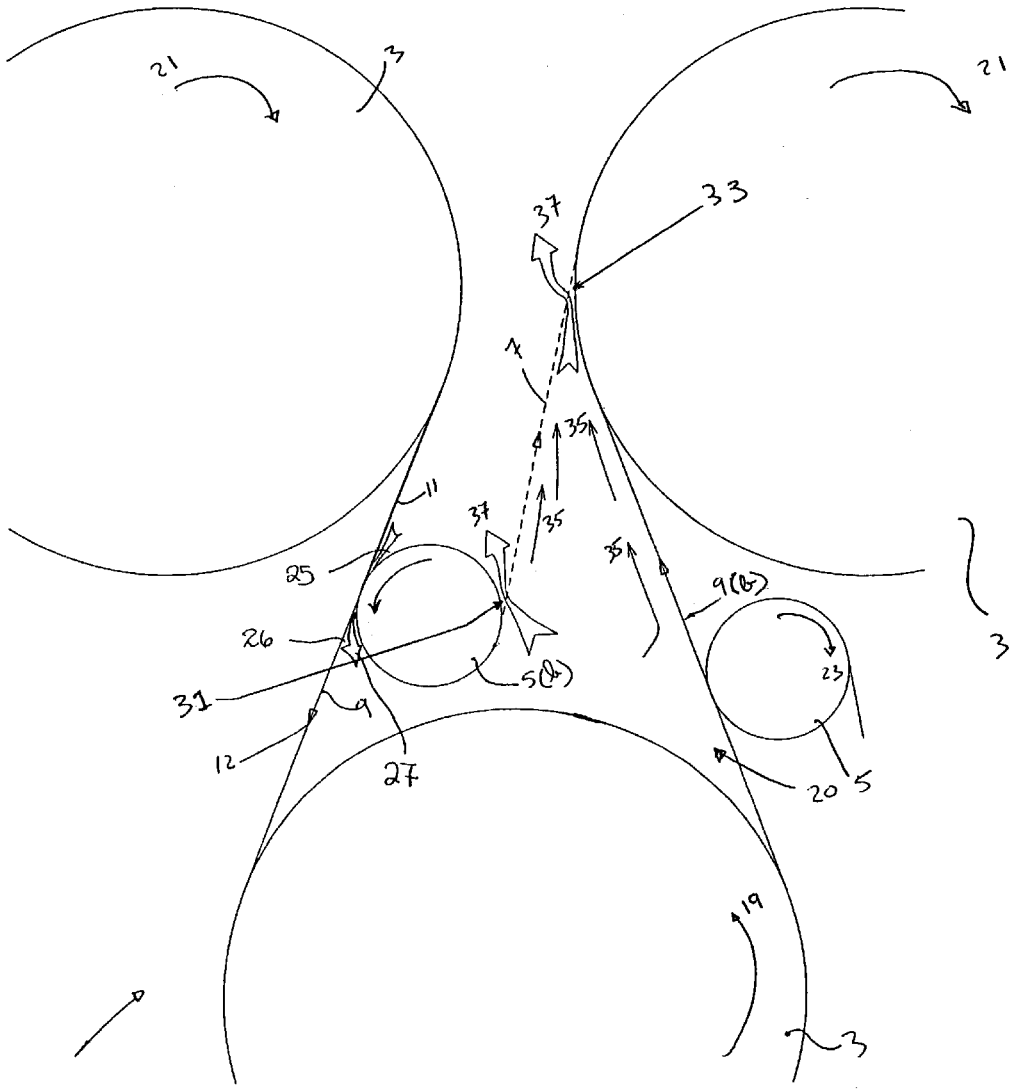
FIG. 3 is a view similar to FIG. 2, showing some natural air flows in an offset pocket as shown in FIG. 1.

FIG. 3 is another enlarged schematic side elevation view illustrating some of the natural air flow patterns which are likely to occur within the offset pocket 20. As illustrated, the paper web 9 is made to advance in the direction of motion arrow 12 through the synchronized rotation of the drying rolls 3 in the direction of motion arrows 19 and 21. As may be understood, the velocity at which the paper web 9 is carried through the papermaking machine 1 is generally in the range of 2,000 to 6,000 feet per minute, which high speed velocity generally creates some air flows in the offset pocket 20, especially at the higher range of such speeds. In particular, in the area of the offset pocket 20, air currents are created in the direction of motion arrows 35, thus towards the upper right-hand drying roll 3. Since the paper web 9 is impermeable to air, air displaced upwardly in the direction of motion arrows 35 will have a tendency to pass through the felt 7 in the directions of motion arrows 37.

Further, the accumulation of air in the upper right-hand corner between open felt draw 7 and the upper right-hand drying roll 3 in what is known as a closing nip area 33 generates a positive air pressure. Similarly, the area where the open felt draw 7 pulls away from the felt roll 5 is known as an opening nip area 31 at which a negative pressure occurs. As is understood, air tends to flow from an area of positive pressure to an area of negative pressure, thus following the motion arrows 37. There is also a closing nip 25 where the felt goes over the felt roll 5. The closing nip 25 is under a positive air pressure and tends to force air towards an opening nip 26 located where the paper web 9 pulls away from the felt 7 and the felt roll 5. Because of the positive pressure created at the closing nip 25 and the negative pressure at the opening nip 26, an air current is created, following motion arrow 27.

Figure 4:
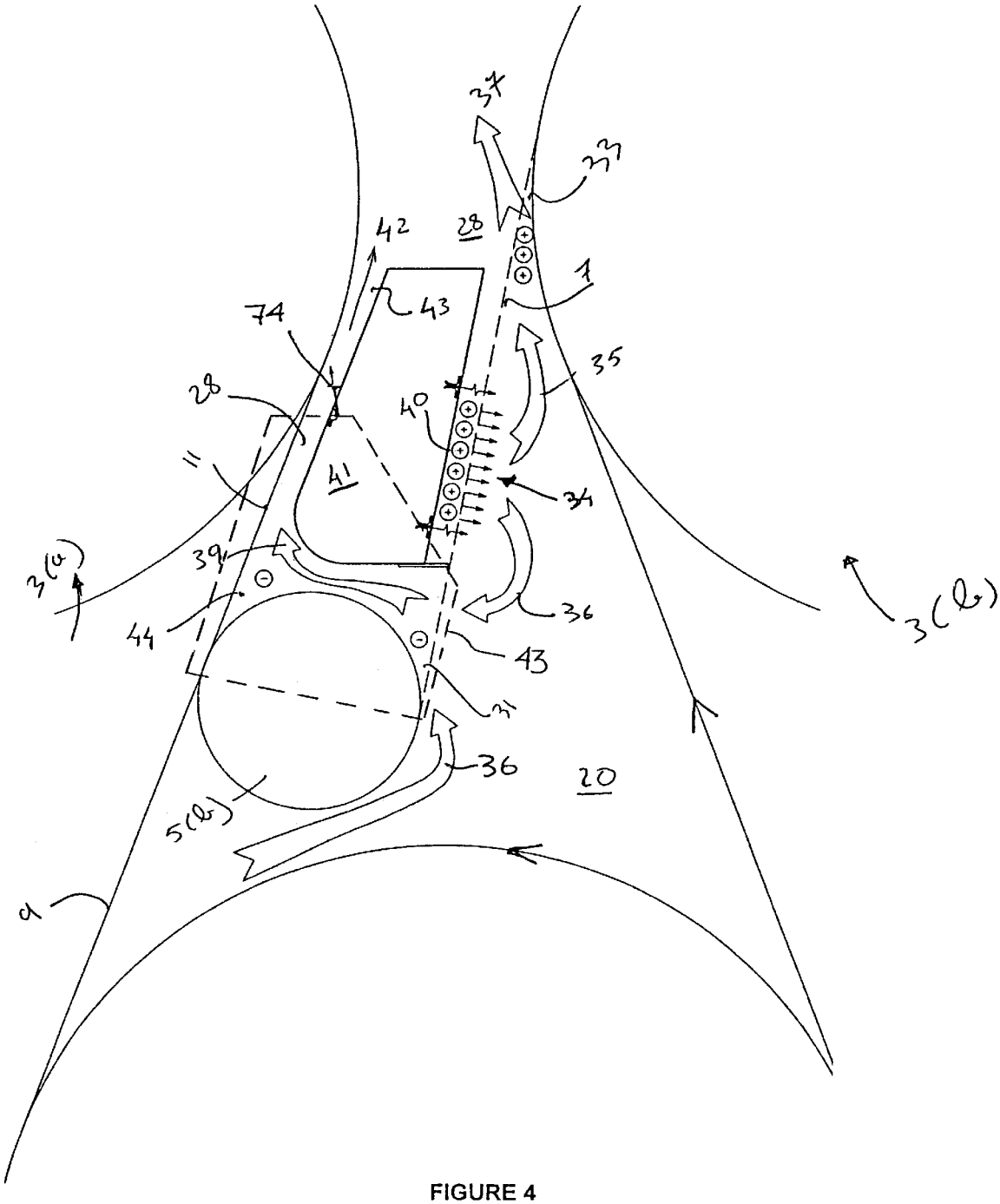
FIG. 4 is a view similar to FIGS. 2 and 3, including a pocket ventilator in accordance with a possible and preferred embodiment.

In order to enhance or facilitate the natural flow of air in the offset pocket 20 and therefore promote the ventilation of the offset pocket 20, a pocket ventilator 41 is disposed in an open pocket 28, which pocket 28 is above the offset pocket 20, as illustrated in FIG. 4. It is understood that the configuration of FIG. 4, where a pocket ventilator 41 is shown disposed adjacent to an upper offset pocket, may be replicated to provide for a ventilator in a corresponding area adjacent to a lower offset pocket 22 shown in FIG. 1. The pocket ventilator 41, illustrated in a cross-section, is usually disposed to cover substantially the whole width of a papermaking machine, thus extending from one lateral side to another. Alternatively, the pocket ventilator 41 may be in the form of a plurality of distinct boxes spaced along the width of a papermaking machine, each of which are individually connected to a corresponding air supply or each being connected to a common air supply.

The structure of the pocket ventilator 41 is preferably comprising an elongated and hollow sheet metal structure. This structure may be made of a variety of different materials, such as galvanized steel, stainless steel, painted steel, aluminum, or any combination of these or other material. As may be understood, the configuration and disposition of the pocket ventilator 41 within the open pocket 28 may be modified from that shown in FIG. 4 in order to suit the particular design requirement of a given papermaking machine. In particular, the size of the ventilator may be modified, such that it may not occupy as much space within the open pocket 28.

As may be understood, the pocket ventilator 41 takes advantage of the naturally occurring air currents in the offset pocket 20, and by introducing or evacuating air therein at appropriate locations, it enhances, assists and accelerates the air currents to ultimately improve the ventilation of the offset pocket 20. This objective is accomplished through the creation of an air pressure differential or gradient across the felt 7. As air will flow from an area of higher (i.e. positive) pressure to an area of lower pressure, to increase air flow into offset pocket 20, one may create such a pressure differential, for example, by increasing the air pressure on the ventilator 41 in a region adjacent to the felt 7. As may be seen, the discharge of air from ventilator 41 in a volume disposed between the ventilator 41 and the felt 7 adjacent thereto will cause air pressure to increase in this volume 40. This may be further enhanced if the volume is bounded by a seal assembly to contain the volume of positive pressure, as illustrated for instance in FIGS. 7 and 8.

Similarly, as explained above, the opening nip area 31 is generally an area of negative air pressure. The area of negative air pressure has a tendency to draw adjacent air which is at a higher pressure, and in this case promotes the movement of air from the other side of the felt 7 as illustrated in FIG. 3 by motion arrows 37, into the opening nip area 31. Air is introduced in the pocket 20 by creating an over pressure in the volume 40 thus forcing air through the wire 7 and into the pocket 20, as illustrated in FIG. 4.

In order to enhance the amount of air evacuated at the opening nip 31, the pressure differential is increased across the felt 7 in the area of the opening nip 31. To do so, a negative pressure is generated in the areas 44 and 28 with an air jet 74 blowing in a direction generally opposite the direction of the felt 7. Consequently, the amount of air evacuated from the pocket 20 at opening nip 31 is increased and this promotes a better mixture of the dry air injected in the pocket 20 and moisture evaporating from the paper web 9. Overall, this achieves a better pocket ventilation.

As an added benefit from the air jet 74, the negative pressure created at areas 44 and 28 will also ensure a better and tighter contact between the paper web 9 and the felt 7 over the combined draw 11, which contact is desirable to achieve better sheet stability.

Preferably, the lateral outsides of the area between the ventilator 41 and the felt roll 5, up to about the air jet 74, are covered by a corresponding seal 43. The seals 43 prevent air from directly entering areas 28, 31 and 44 from the sides of the papermaking machine 1. It should be noted that the seals 43 can have many other shapes from the one illustrated in FIG. 4.

Figure 5:
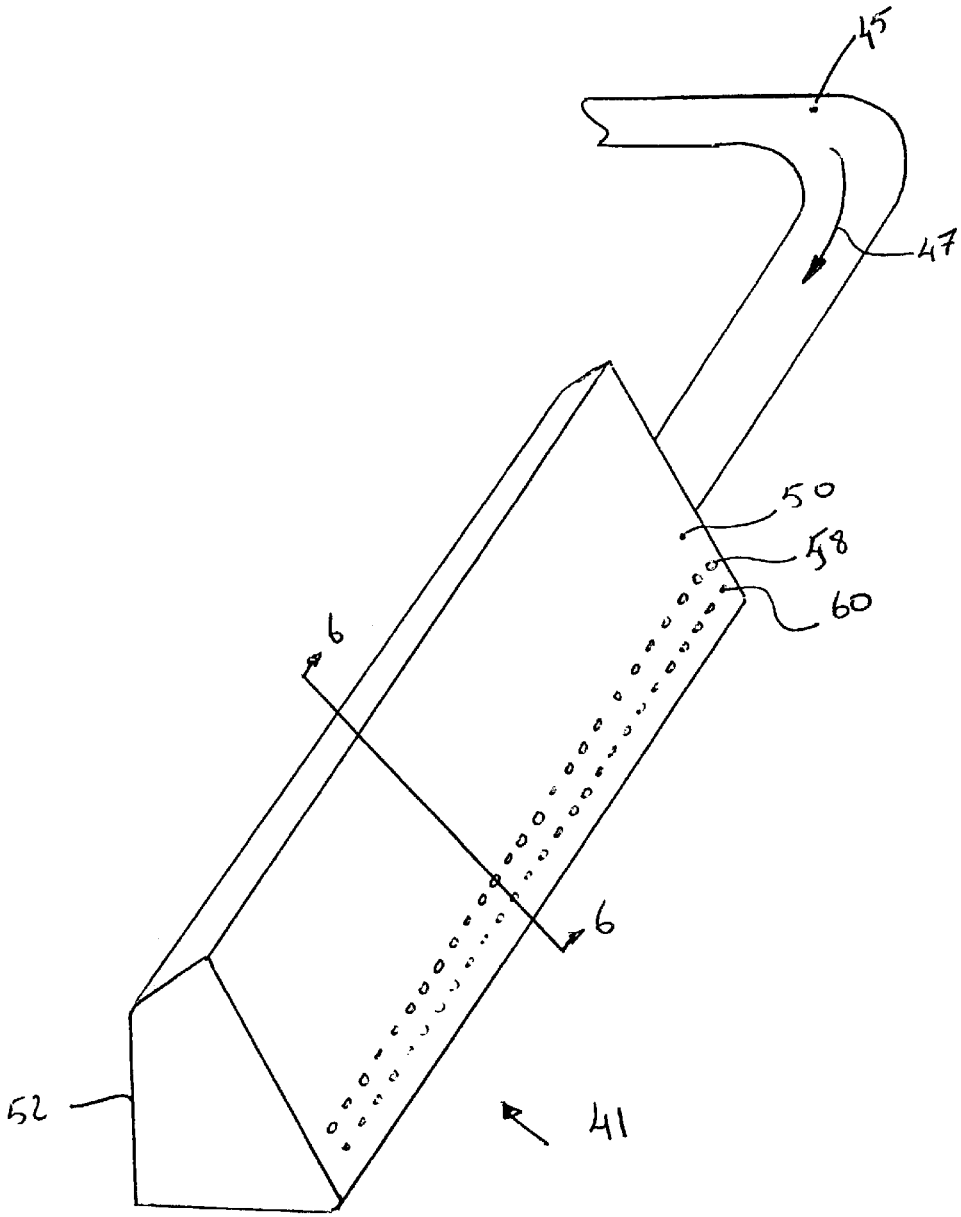
FIG. 5 is a schematic perspective view of the ventilator of FIG. 4, showing possible connection to an air supply duct.

FIG. 5 shows a schematic perspective view of an air ventilator in accordance with a possible and preferred embodiment. The ventilator 41 comprises a ventral face 50 and a dorsal face 52, wherein the ventral face 50 is disposed towards the dry end 17 of the machine and the dorsal face is oriented towards the wet end 15 thereof. Although the pocket ventilator 41 is shown disposed in this manner in order to be disposed in the open pocket 28 above offset pocket 20, as illustrated in FIG. 4, it is understood that the ventral face 50 and dorsal face 52 may be oriented in a different position than that illustrated in FIG. 5, for example in an inverted position, the whole in accordance with the configuration of the offset pocket 20, which may be a function of the configuration of the papermaking machine. Further, the bottom offset pocket 22, illustrated in FIG. 1, requires a pocket ventilator 41 having a disposition which is inverted from the configuration shown in FIG. 5. It should be noted that the pocket ventilator 41 in most papermaking machines would be much longer than illustrated if it is a one-piece structure wherein the ventral face 50 is still oriented towards the dry end 17 of the papermaking machine.

As also illustrated in FIG. 5, the pocket ventilator 41 is shown to be connected to a pipe, duct, or other air communications carrier 45. Motion arrow 47 indicates the direction of air which may be pumped, pushed or otherwise introduced into the duct 45 to be distributed. Thus, the introduction of air into the pocket ventilator 41 causes the inside of the pocket ventilator 41 to be under positive pressure. Although air, in particular heated air or most preferably heated dry air, is the most likely fluid to be introduced into the duct 45 and the pocket ventilator 41, it is understood that any other fluid, such as any other gas, may be introduced therein, or in addition to the air, in order to meet operational constraints. The word <<air>> should be construed to cover all these cases.

Figure 6:
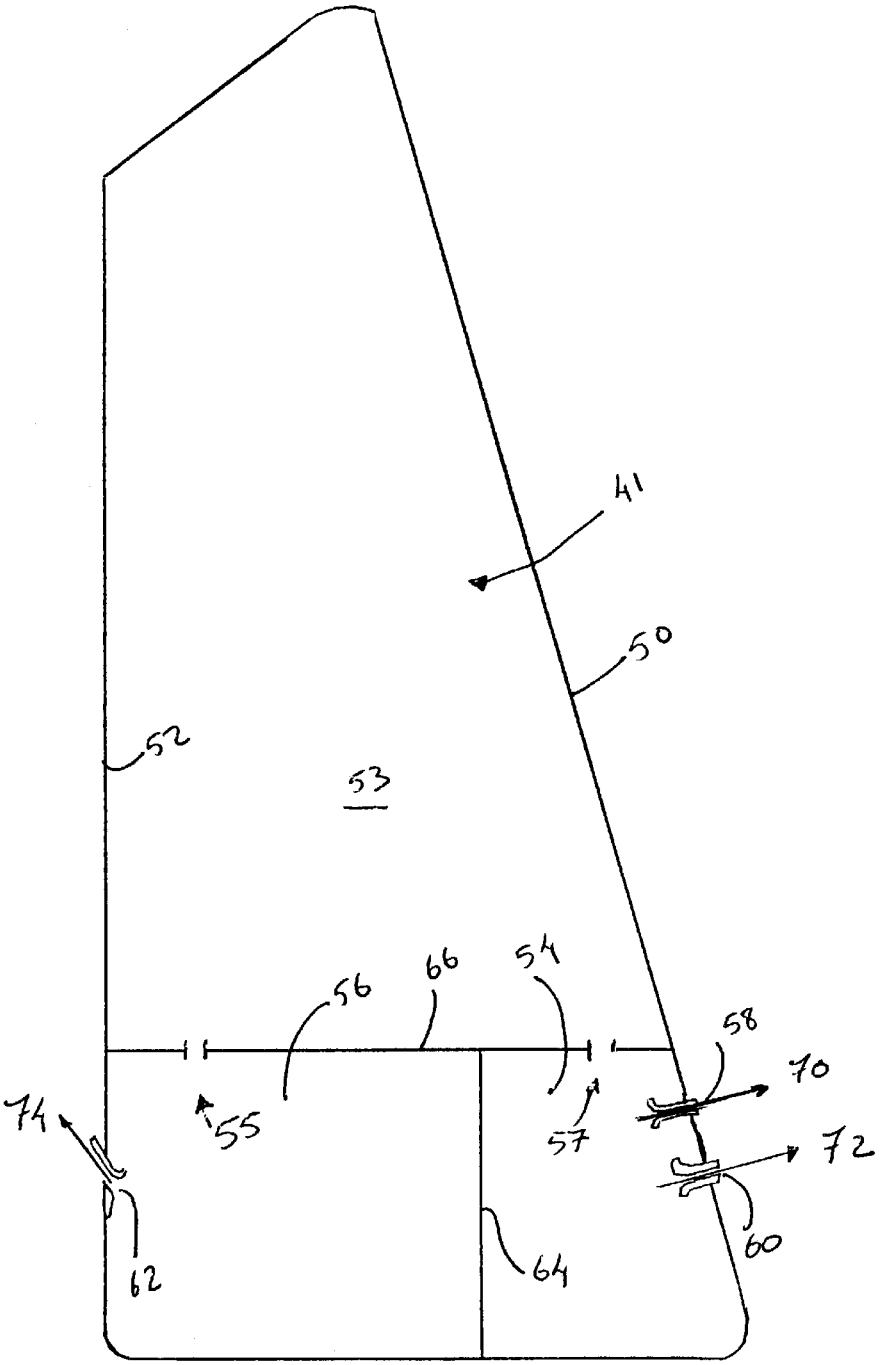
FIG. 6 is a sectional view of the ventilator along view lines 6—6 of FIG. 5.

FIG. 6 illustrates a cross-sectional view along view lines 6—6 in FIG. 5. As illustrated, the pocket ventilator 41 comprises a ventral face 50 and a dorsal face 52. The inside volume of the pocket ventilator 41 may be divided into a number of chambers. For instance, perforated baffles 66 and 64 may divide the interior of the pocket ventilator 41 into three chambers 53, 54 and 56. As illustrated, the pocket ventilator 41 comprises, on its ventral face 50, two openings or orifices 58 and 60. Air provided by the duct 45 is preferably introduced first into chamber 53 for distribution into the chambers 54 and 56 through a series of perforations 55 and 57 made in baffle 66. Alternatively, the duct 45 may provide air directly into the chambers 54 and 56, or into only one of them, in which case a series of additional orifices would be made in the baffle 64. Air could further be supplied by other appropriate air communications carriers. As may be understood, the supply of air into the inside of the pocket ventilator 41 may therefore be accomplished in a variety of ways.

Orifices or openings 58 and 60 are oriented with respect to ventral face 50 such that a stream of air 70 and 72 is forced towards the felt 7, as shown in FIG. 4, preferably at substantially right angle thereto. Further, as illustrated, air streams 70 and 72 are substantially parallel one with the other, although it is understood that the orientation of the streams may be different such that the streams may be convergent or divergent. It may be further understood that additional orifices may be provided for on ventral face 50, for example in the chamber 53. Alternatively, the orifices may only be found on ventral face 50 opposite the chamber 53. As best illustrated in FIG. 5, the orifices 58 and 60 are preferably distinct, spaced apart openings, although it is understood that orifices 58 and/or 60 may be in the form of a slot extending the length of the pocket ventilator 41, or comprise a number of smaller slots, or any other combination of required or desired openings.

The pocket ventilator 41 also comprises a third orifice 62 from which a third air stream 74 is ejected, preferably from the chamber 56. As may be seen, the third orifice 62 is preferably oriented in such a manner that air stream 74 is ejected at a pronounced downstream angle in a direction generally opposite the direction of the felt 7. It is understood that the location of the orifice 62 may alternatively be found on any position on the dorsal face 52, and there may be additional orifices on the dorsal face 52 than that illustrated in FIG. 6.

Figure 7:
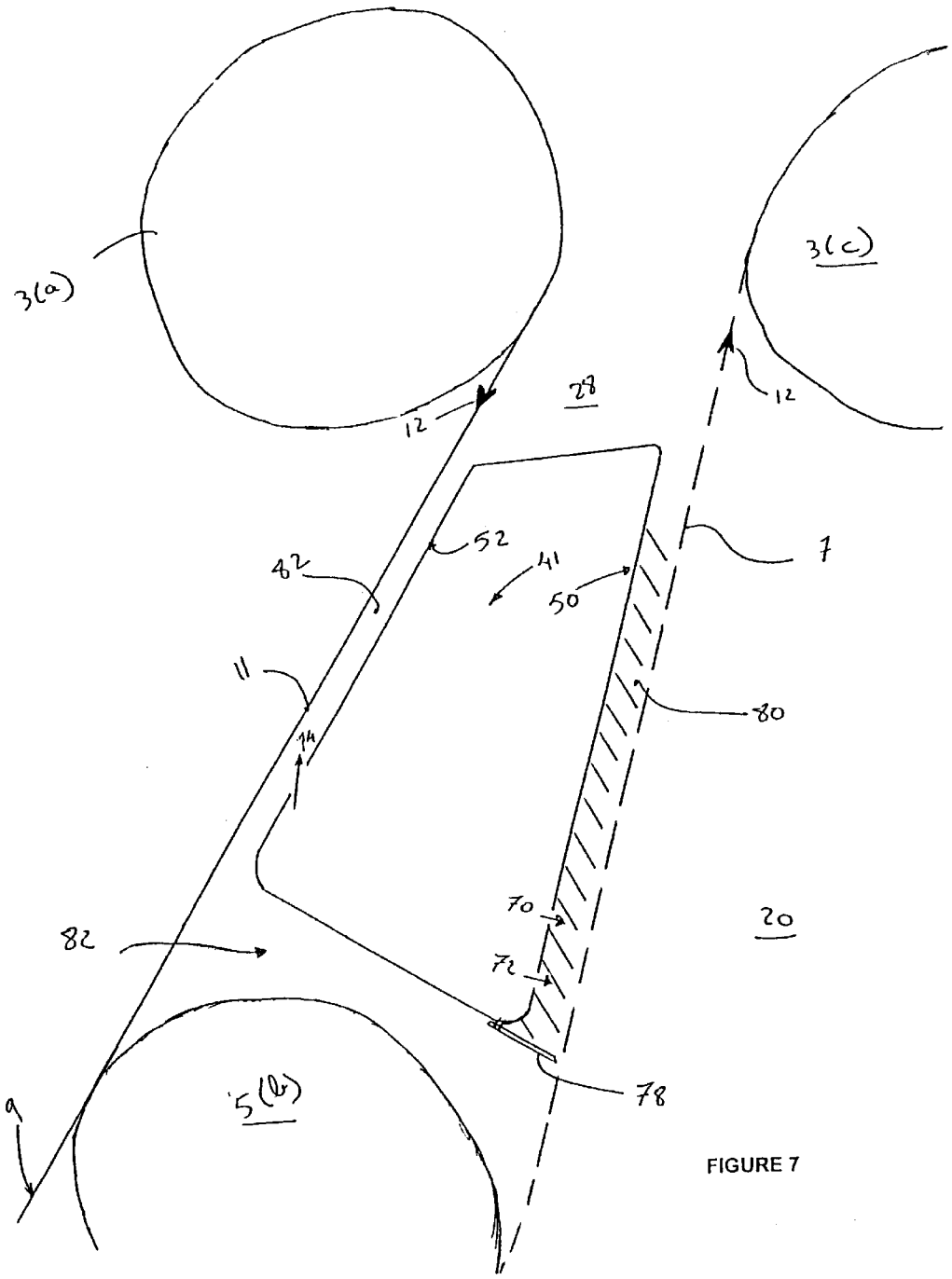
FIG. 7 is an enlarged schematic side view of a ventilator in accordance with another possible embodiment.

FIG. 7 is another enlarged view showing the pocket ventilator 41 disposed in the open pocket 28 above offset pocket 20, as illustrated in FIGS. 1 through 4. In this embodiment, the pocket ventilator 41 comprises a seal assembly 78, which as illustrated comprises a gasket disposed adjacent to its lowermost portion. Further, as may be understood, if a pocket ventilator 41 is to be used in a lower offset pocket 22, as illustrated in FIG. 1, the gasket of the seal assembly 78 would inversely be disposed from what is illustrated in FIG. 7. Further, even though the gasket of the seal assembly 78 is shown as projecting from the pocket ventilator 41 at substantially its lowermost portion, it may be understood that seal assembly 78 may be disposed at another location along ventral face 50, for example halfway up the ventral face 50.

The seal assembly 78, if any, divides the open pocket 28 into two separate and distinct zones or volumes, namely a first volume 80 identified by cross hatching, and a second volume 82. As illustrated in FIG. 7, the seal assembly 78 may substantially act as a barrier or seal between the first and second volumes 80 and 82, and may therefore be disposed along the entire length of the pocket ventilator 41. Further, the size of the seal assembly 78 may be such that its free end is disposed as close as possible to the felt 7 in order to be as effective as possible without risking damage thereto. As may be understood, the purpose of seal assembly 78 is to create the first volume 80, which volume is then made under positive pressure by the air streams 70 and 72. This facilitates the flow of air from the pocket ventilator 41 through the felt 7.

Figure 8:
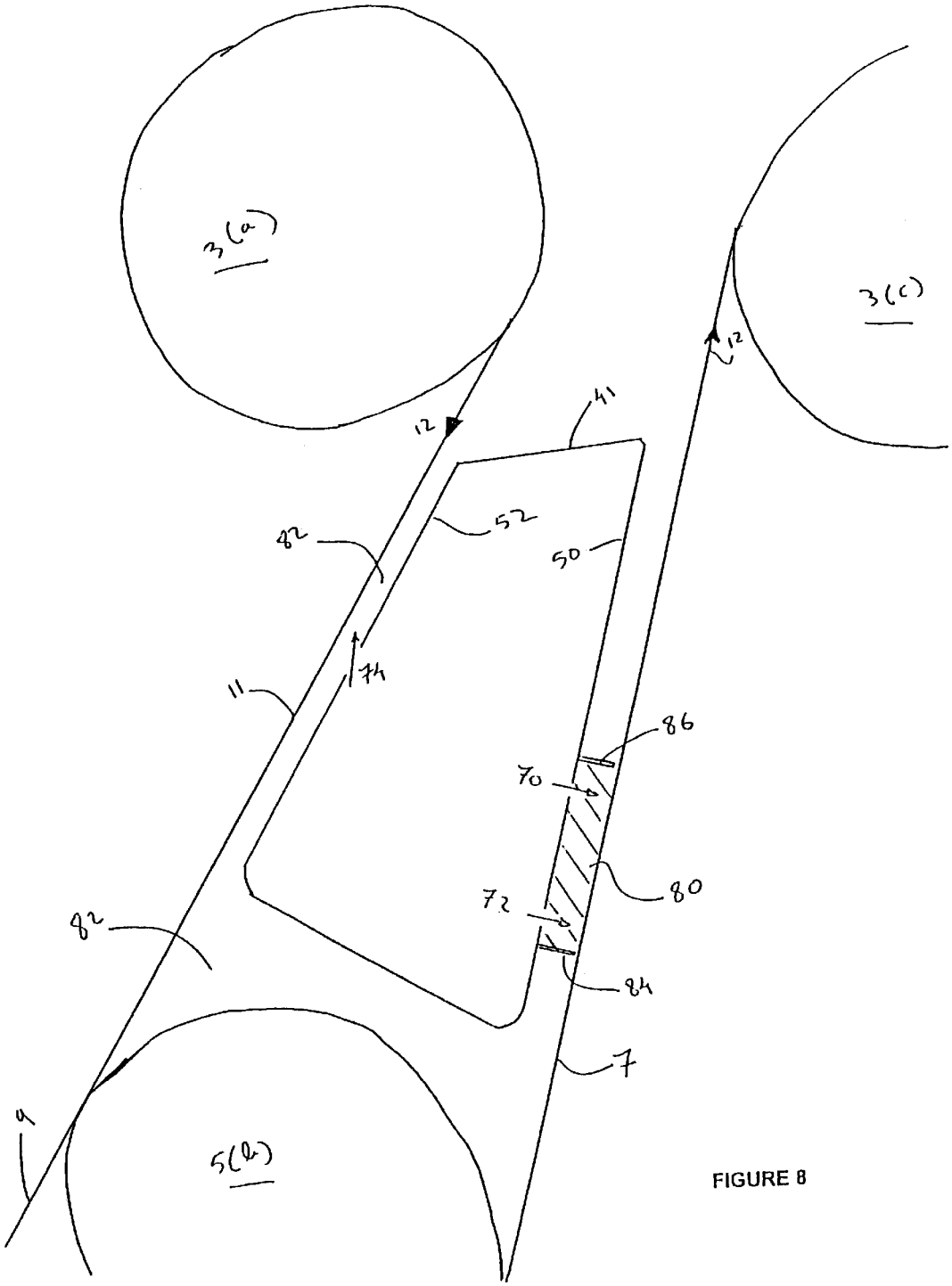
FIG. 8 is a view similar to FIG. 7, illustrating a further possible embodiment.

FIG. 8 illustrates another possible embodiment, where the seal assembly comprises both a lower gasket 84 and an upper gasket 86. As a further embodiment, the upper gasket 86 may be disposed on the ventral face, at or substantially at the outermost extremity of the ventral face 50.

The particular embodiments shown herein are by way of example only, and are for purposes of illustrative discussion of the many possible embodiments of the present invention. They are presented for illustration and easy reference. The illustrations and description should not be interpreted in any limiting manner. As will be apparent to one skilled in the art, further embodiments may also be devised within the scope of the present invention.

What is claimed is:

1. A ventilator for ventilating an offset pocket located in a drying section of a papermaking machine by injecting air from at least one air supply, the offset pocket being situated between a set of three axially parallel drying rolls over which consecutively runs a paper web, a first and a third of these drying rolls being vertically spaced from a second of the drying rolls, the paper web being pressed against the first and the third drying roll by a felt which further runs over a felt roll having a rotation axis parallel to that of the drying rolls, the felt roll being disposed between the three drying rolls in an offset position which is closer to the first drying roll than the third drying roll, the felt and paper web defining a combined draw from over the first drying roll to the felt roll, the felt further defining an open felt draw from the felt roll to the third drying roll, the ventilator being disposed in an open pocket delimited by the first drying roll, the combined draw, the felt roll, the open felt draw and the third drying roll, the ventilator comprising:

at least one ventral orifice disposed on a ventral face thereof which is adjacent to the open felt draw; and at least one dorsal orifice disposed on a dorsal face thereof which is adjacent to the combined draw;

whereby, in use, the ventral orifice discharges air through the open felt draw and into the offset pocket, the dorsal orifice discharges air in a direction which is substantially opposite the direction of travel of the combined draw to create a countercurrent air flow between the ventilator and the felt roll.

2. A ventilator according to claim 1, further comprising lateral seals, each preventing air surrounding the sides of the papermaking machine from directly entering into an area substantially defined between the combined draw, a free surface of the felt roll, a portion of the open felt draw, and a portion of the dorsal face of the ventilator, which portion faces the free surface of the felt roll and an unsupported portion of the combined draw.

3. A ventilator according to claim 2, wherein the ventral orifice is configured to be continuous along the length of the ventral face.

4. A ventilator according to claim 2, wherein the ventral orifice comprises a plurality of spaced apart openings.

5. A ventilator according to claim 4, wherein the plurality of spaced apart openings are regularly spaced apart along the ventral face.

6. A ventilator according to claim 2, wherein the dorsal orifice is configured to be continuous along the length of the dorsal face.

7. A ventilator according to claim 2, wherein the dorsal orifice comprises a plurality of spaced apart openings.

8. A ventilator according to claim 7, wherein the plurality of spaced apart openings are regularly spaced apart along the dorsal face.

9. A ventilator according to claim 2, wherein the ventilator comprises a seal assembly having at least one gasket projecting outwardly from the ventilator from the ventral face towards the open felt draw.

10. A ventilator according to claim 9, wherein the gasket is disposed adjacent to the felt roll.

11. A ventilator according to claim 9, wherein the seal assembly comprises a first gasket having a free end disposed adjacent to the felt roll and a second gasket having a free end disposed downstream the ventral orifice.

12. A ventilator for ventilating an offset pocket located in a drying section of a papermaking machine by injecting air from at least one air supply, the offset pocket being situated between a set of three axially parallel drying rolls over which consecutively runs a paper web, a first and a third of these drying rolls being vertically spaced from a second of the drying rolls, the paper web being pressed against the first and the third drying roll by a felt which further runs over a felt roll having a rotation axis parallel to that of the drying rolls, the felt roll being disposed between the three drying rolls in an offset position which is closer to the first drying roll than the third drying roll, the felt and paper web defining a combined draw from over the first drying roll to the felt roll, the felt further defining an open felt draw from the felt roll to the third drying roll, the ventilator being disposed in an open pocket delimited by the first drying roll, the combined draw, the felt roll, the open felt draw and the third drying roll, the ventilator comprising:

at least one ventral orifice disposed on a ventral face thereof adjacent to the open felt draw;

at least one dorsal orifice disposed on a dorsal face thereof and adjacent to the combined draw; and a seal assembly dividing the open pocket into a first volume associated with the ventral orifice and a second volume associated with the dorsal orifice;

whereby, in use, the ventral orifice discharges air in the first volume, which air then goes through the open felt draw and into the offset pocket, the dorsal orifice discharges air in the second volume in a direction which is substantially opposite the direction of travel of the combined draw to create a countercurrent air flow between the ventilator and the felt roll.

13. A ventilator according to claim 12, further comprising lateral seals, each preventing air surrounding the sides of the papermaking machine from directly entering into an area defined between the combined draw, a free surface of the felt roll, a portion of the open felt draw, and a portion of the dorsal face of the ventilator, which portion faces the free surface of the felt roll and an unsupported portion of the combined draw.

14. A ventilator according to claim 13, wherein the ventral orifice is configured to be continuous along the length of the ventral face.

15. A ventilator according to claim 14, wherein the ventral orifice comprises a plurality of spaced apart openings.

16. A ventilator according to claim 15, wherein the plurality of spaced apart openings are regularly spaced apart along the ventral face.

17. A ventilator according to claim 13, wherein the dorsal orifice is configured to be continuous along the length of the dorsal face.

18. A ventilator according to claim 13, wherein the dorsal orifice comprises a plurality of spaced apart openings.

19. A ventilator according to claim 18, wherein the plurality of spaced apart openings are regularly spaced apart along the dorsal face.

20. A ventilator according to claim 13, wherein the seal assembly comprises a gasket disposed adjacent to the felt roll.

21. A ventilator according to claim 20, wherein the seal assembly comprises a first gasket disposed adjacent to the felt roll and a second gasket disposed above the ventral orifice.

22. A method for ventilating an offset pocket located in a drying section of a papermaking machine by injecting air from at least one air supply, the offset pocket being situated between a set of three axially parallel drying rolls over which consecutively runs a paper web, a first and a third of these drying rolls being vertically spaced from a second of the drying rolls, the paper web being pressed against the first and the third drying roll by a felt which further runs over a felt roll having a rotation axis parallel to that of the drying rolls, the felt roll being disposed between the three drying rolls in an offset position which is closer to the first drying roll than the third drying roll, the felt and paper web defining a combined draw from over the first drying roll to the felt roll, the felt further defining an open felt draw from the felt roll to the third drying roll, the method comprising the step of:

providing a ventilator between the combined draw and the open felt draw, the ventilator having a ventral face and a dorsal face;

discharging air from the ventral face of the ventilator through the open felt draw; and establishing a negative pressure zone by discharging air from the dorsal face of the ventilator in a direction which is substantially opposite the direction of travel of the combined draw to create a countercurrent air flow between the ventilator and the felt roll.

23. A method according to claim 22, wherein the method comprises the step of preventing air surrounding the sides of the papermaking machine from directly entering into an area defined between the combined draw, a free surface of the felt roll, a portion of the open felt draw, and a portion of the dorsal face of the ventilator, which portion faces the free surface of the felt roll and an unsupported portion of the combined draw.

* * * * *